US005577957A

United States Patent [19]

Hoormann et al.

[11] Patent Number: 5,577,957

[45] Date of Patent: Nov. 26, 1996

[54] COIN PAYOUT METHOD AND CONTROL APPARATUS

[75] Inventors: Ronald A. Hoormann, St. Charles County; Joseph L. Levasseur, St. Louis County, both of Mo.

[73] Assignee: Coin Acceptors, Inc., St. Louis, Mo.

[21] Appl. No.: 404,177

[22] Filed: Mar. 13, 1995

[51] Int. Cl.[6] ..... G07D 1/06

[52] U.S. Cl. ..... 453/17

[58] Field of Search ..... 194/216, 217, 194/218; 453/17

[56] References Cited

U.S. PATENT DOCUMENTS

| | | | |
|---|---|---|---|
| 3,754,629 | 8/1973 | Douglass | 194/201 |
| 3,820,642 | 6/1974 | Levasseur | 194/217 |
| 3,841,456 | 10/1974 | Levasseur | 194/217 |
| 3,963,035 | 6/1976 | Levasseur | 194/216 X |
| 4,188,961 | 2/1980 | Heiman | 194/216 X |
| 4,192,972 | 3/1980 | Bertoglio et al. | 179/6.3 |
| 4,376,478 | 3/1983 | Sugimoto et al. | 194/218 |
| 4,462,512 | 7/1984 | Schuller | 194/217 |
| 4,491,140 | 1/1985 | Eglise et al. | 194/217 X |
| 4,499,982 | 2/1985 | Sugimoto et al. | 194/217 |
| 4,512,454 | 4/1985 | Schuller et al. | 194/346 |
| 4,587,984 | 5/1986 | Levasseur et al. | 453/17 |
| 4,706,202 | 11/1987 | Kobayashi et al. | 364/479 |
| 4,763,769 | 8/1988 | Levasseur | 194/217 |
| 4,883,158 | 11/1989 | Kobayashi et al. | 194/217 |
| 5,092,816 | 3/1992 | Levasseur | 453/17 |
| 5,184,708 | 2/1993 | Levasseur | 194/217 |
| 5,197,588 | 3/1993 | Furuya et al. | 194/217 |

FOREIGN PATENT DOCUMENTS

| | | | |
|---|---|---|---|
| 2269258 | 2/1994 | United Kingdom | 453/20 |
| 9403875 | 2/1994 | WIPO . | |

*Primary Examiner*—F. J. Bartuska
*Attorney, Agent, or Firm*—Haverstock, Garrett and Roberts

[57] ABSTRACT

The present invention relates, in one form thereof, to making a coin payout from a vending machine having a processor for processing data and a plurality of coin tubes for storing coins, each coin tube having one coin denomination type stored therein. The machine further includes coin counter, coupled to the coin tubes and to the processor, for determining when a coin is deposited in each coin tube and when a coin is removed from each coin tube. In one form of the present invention, the processor is programmed to determine whether certain conditions are satisfied for a particular vend and, if such conditions are satisfied, paying out at least one coin selected on the basis of predetermined criteria.

26 Claims, 5 Drawing Sheets

| | PAYOUT AMOUNT | COIN TUBES | | | | COIN AVAIL. | | | | LEAST COIN PAYOUT ROUTINE | | | | SAVE COINS PAYOUT ROUTINE | | | |
|---|---|---|---|---|---|---|---|---|---|---|---|---|---|---|---|---|---|
| | | D | Q | D | N | D | Q | D | N | D | Q | D | N | D | Q | D | N |
| 1. | 70 ¢ | --- | X | X | X | --- | F | F | F | --- | 2 | 2 | 0 | --- | 2 | 2 | 0 |
| 2. | $1.20 | X | X | X | X | A | F | F | F | 1 | 0 | 2 | 0 | 0 | 4 | 2 | 0 |
| 3. | $1.20 | X | X | X | X | A | A | A | F | 1 | 0 | 2 | 0 | 1 | 0 | 1 | 2 |
| 4. | $1.20 | X | X | X | X | A | A | A | A | 1 | 0 | 2 | 0 | 1 | 0 | 2 | 0 |

Fig. 4

COIN PAYOUT METHOD AND CONTROL APPARATUS

FIELD OF THE INVENTION

The present invention relates to providing change to customers from vending machines and, more particularly, to improving the mix of coins stored in the coin tubes of such a machine.

BACKGROUND OF THE INVENTION

Vending machines often include change payout apparatus for paying out change to a customer in the event of an excess deposit, i.e., a deposit which exceeds the vend price. Examples of such vending machines are set forth in U.S. Pat. Nos. 3,754,629, 3,820,642, and 3,841,456, all of which are assigned to the present assignee.

In vending machines capable of paying out change in the event of an excessive customer deposit, a plurality of a coin tubes generally are utilized for storing coins. Each coin tube is designated to store coins of one denomination, e.g., quarter, nickel, or dime. Initially, an operator fills each coin tube with the designated denomination. In operation, when a customer makes an excess deposit, the amount of change due is determined and paid out from the coin tubes.

To avoid having to frequently manually replenish the coin tubes, a deposited coin is supplemented to coins of the same denomination stored in a coin tube if the coin tube is not full. If the coin tube is full, a deposited coin is routed to a cash box. For example, if the quarter tube is not full, deposited quarters will be routed to the quarter tube. If the quarter tube is full, deposited quarters will be routed to the cash box. Examples of vending machines including coin tubes and routing mechanisms are set forth in U.S. Pat. Nos. 3,963,035, 4,587,984, and 5,184,708, all of which are assigned to the present assignee.

Vending machines also typically include structure to sense the number of coins in each coin tube and to control the payout of change using the highest possible denominations of coins. Lower denomination coins are used if the quantity of coins in the higher denomination coin tubes has fallen below a predetermined level. Paying out change using the highest possible denominations of coins generally is known as a "least coin payout". Paying out change using the highest denomination of coins facilitates maintaining a better "mix" of coins stored in the coin tubes and operating a vending machine for longer periods of time without requiring customers to deposit exact change.

Once the quantity of coins in a coin tube falls to a predetermined level, and if payout of proper change is not possible without a coin from such tube, the vending machine requires an exact deposit equal to the vend price to make a sale. A customer, fully aware that proper change is not possible, could still make an excess deposit and a vend operation would be performed. Under such circumstances, however, the customer will receive a payout less than the difference between the vend price and the amount deposited. Examples of such coin level detection and payout control are set forth in U.S. Pat. Nos. 3,963,035 and 4,587,984, which are mentioned above, and U.S. Pat. No. 4,763,769, which is assigned to the present assignee.

Since many customers often do not have coins readily available to make such an exact deposit, sales usually are lost when a vending machine requires exact deposit. Further, having an operator frequently replenish the coin tubes for each vending machine generally is expensive, particularly when a number of vending machines are located in a large geographic area.

Although the least coin payout method is useful and provides many advantages, there exists a need for maintaining even a better mix of coins stored in the coin tubes. For example, one coin denomination may not be paid out as often as other coin denominations, even though such one coin denomination is available and could be used. As a result, the coin tube for the one denomination remains full as other coin tubes are depleted.

Attempts to maintain a better mix of coins stored in the coin tubes include payout systems which generate and evaluate a plurality of alternative payout combinations. Specifically, using alternative payout methodologies, alternative payout combinations or arrays are generated. One payout combination is then selected, based on, for example, which combination is "best", for making the actual payout. A hierarchy of rules may be utilized to determine which combination is "best". An example of such a system is described in PCT Patent Application WO 94/03875, published Feb. 17, 1994. Such systems which generate alternative payout combinations and then select one combination to make the actual payout are complex, certainly as compared to routines which only make a payout using the least coin payout method. The more complex routines are more difficult to implement and are more susceptible to errors. Such routines also require more memory storage, which typically increases the cost of the systems.

Accordingly, it is desirable and advantageous to provide a vending machine capable of paying out change for long periods of time without requiring an operator to manually replenish the coin tubes. It is also desirable and advantageous to provide a change payout routine which is easy to implement, does not require excessive memory, yet controls operations so as to maintain a better mix of coins stored in the coin tubes of a vending machine.

An object of the present invention is to provide a vending machine capable of paying out change for long periods of time without requiring an operator to manually replenish the coin tubes.

Another object of the present invention is to provide a vending machine which provides an accurate payout to a customer and operates to facilitate preventing the quantity of coins for each coin type stored in the machine coin tubes from falling below a predetermined level.

Yet another object of the present invention is to provide a change payout routine which is easy to implement, does not require excessive memory, and controls operations so as to maintain a better mix of coins stored in the coin tubes.

SUMMARY OF THE INVENTION

These and other objects of the invention are obtained in an assembly constructed in accordance with the present invention. In carrying the various objects of the present invention in one form thereof, a microprocessor-based vending machine is provided, such as the machine described in U.S. Pat. No. 4,763,769, which is assigned to the present assignee. The machine includes processing means and a plurality of coin tubes.

Coin tube status means, which may include counters, monitor the deposit and payout of coins from each coin tube. In one embodiment, for example, one counter is associated with each coin tube. The counter associated with a particular coin tube is incremented each time a coin is deposited in the tube and the counter is decrement each time a coin is paid out from the tube. The instantaneous value of the counter is equal to "coins in" minus "coins out" for the associated tube. Such a value is sometimes referred to herein as a "coin count".

After a deposit is made in the vending machine, the amount of change due, if any, is determined by the processing means. If change is due, i.e., a payout is to be made, the processing means sets the total amount of the payout equal to $CHANGE_{TOT}$.

The processing means then checks the status flags for certain conditions and obtains inputs regarding whether the coin tubes having the three lowest coin denomination types stored therein are available for payout. Particularly, the processing means obtains inputs indicating whether the quantity of coins for each such coin type has fallen below a predetermined level. If the quantity of coins for any one of such coin types has fallen below such level, or if any of the status flags are not set as required, then an alternative payout routine is executed.

If the quantity of coins of each such coin type is above the minimum level, and if the status flags are set as required, then a payout is made in accordance with the following. Specifically, one coin of the coin denomination type having the highest value, but having a value less than or equal to $CHANGE_{TOT}$, and stored in a full coin tube (e.g., as determined by a coin tube level sensor) is paid out. If one coin of such a coin type is paid out, $CHANGE_{TOT}$ is updated to equal $CHANGE_{TOT}$—(Value of Coin Paid Out). The remaining amount of change due, i.e., the updated $CHANGE_{TOT}$, is then paid out using the least coin payout routine.

If a coin is not paid out in accordance with the foregoing (i.e., no coin robe storing a coin type satisfying the above stated conditions is full), then one coin of a coin denomination type meeting other criteria is paid out. Particularly, one coin having a value less than or equal to $CHANGE_{TOT}$, excluding the lowest denomination coin type, and stored in a tube that is substantially full, e.g., at least seventy-five percent full, is paid out. If no such coin tube is at least seventy-five percent full, then one coin having a value less than or equal to $CHANGE_{TOT}$, excluding the lowest denomination coin type, and stored in a tube having the highest "coins in" minus "coins out" counter value, is paid out. If two or more coin denomination types satisfy the foregoing conditions, the higher denomination coin type is paid out. After one such coin type is paid out, $CHANGE_{TOT}$ is updated to equal $CHANGE_{TOT}$—(Value of Coin Paid Out). The remaining amount of change due, i.e., the updated $CHANGE_{TOT}$, is then paid out using the least coin payout routine.

By making a payout in accordance with the foregoing, and if the preconditions are satisfied, the vending machine pays out at least one coin from a full coin tube, a substantially full coin tube or from a coin tube having the highest coin count. Such a payout results in saving coins which are more likely, as compared to other coin types in the machine, to first reach a condition in which further payout of such coin type is not possible. Further, by paying out at least one such coin, a better mix of coins are maintained in the coin tubes which facilitates paying out change for long periods of time without requiring an operator to manually replenish the coin tubes. The above described payout routine also is easy to implement and does not require excessive memory.

BRIEF DESCRIPTION OF THE DRAWINGS

FIG. 4 is a table illustrating various payouts.

DETAILED DESCRIPTION OF THE DRAWINGS

Figure 1:
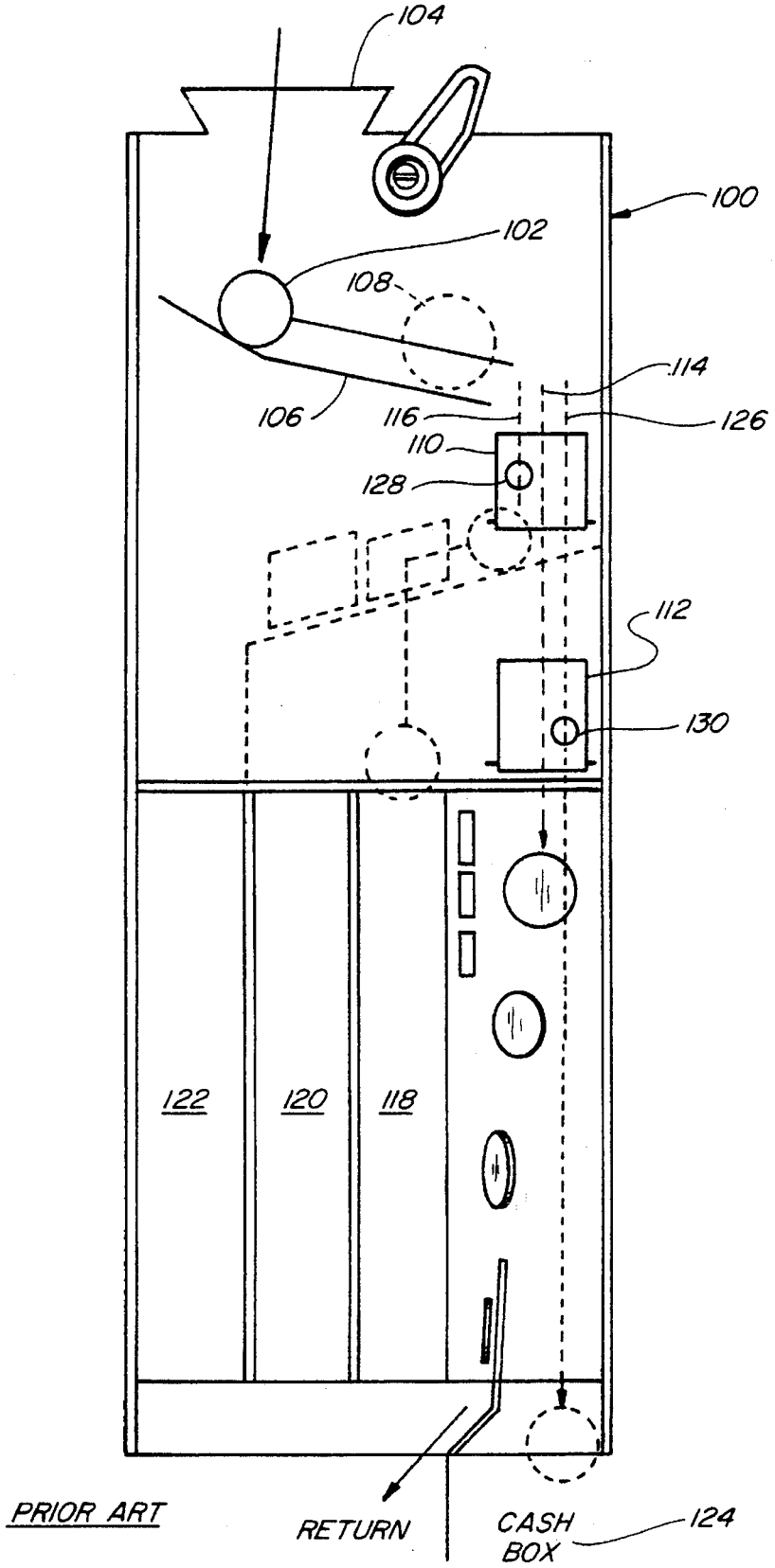
FIG. 1 is a diagrammatic depiction of a typical coin changer unit depicting in simplified formed various possible coin paths in and/or through such unit.

A coin changer unit 100 of the type typically employed in many existing vending systems is illustrated in FIG. 1. Coins, such as coin 102, may be deposited at coin inlet 104, and they thereafter move along a coin path 106, which path may include means of various types for mechanically sizing coins and separating certain kinds of slugs from among the coins deposited, to pass by and/or interact with a coin analysis or sensing means 108 that is operable to produce coin analysis data pertinent to such coin. Numerous types of coin analysis means and coin sensing means are known to those skilled in the art, any number of which means might be equally and advantageously used in vending systems constructed to include the coin payout control means of the present invention. Typical of some of such known coin analysis means and sensing means are constructions disclosed in U.S. Pat. Nos. 4,763,769 and 5,092,816, both of which are assigned to the present assignee and hereby incorporated herein by reference.

Depending upon whether either of the controllably operable diverters or gates 110 or 112 are operated, the coin may thereafter be caused to follow one of several different possible paths. If neither gates 110 or 112 are operated, the coin will follow path 114 to be returned to the customer. If gate 110 is operated, the coin will follow path 116 and, depending upon its denomination, will be directed into dime coin tube 118, nickel coin tube 120, quarter coin tube 122, or, if the appropriate coin tube is filled, will be caused to fall to the front or rear of the coin tubes or otherwise be directed into a coin collection or cash box 124. If gate 112 is operated instead of gate 110, e.g., as in the case of a deposit of a validated and accepted dollar coin, the coin will follow path 126 and be directed into cash box 124. Sensing means, such as sensing means 128 and sensing means 130, may be positioned to detect movement of the deposited coin past or through an appropriate gate or along an appropriate path and to produce sensor signals indicative of such coin detection.

Figure 2:
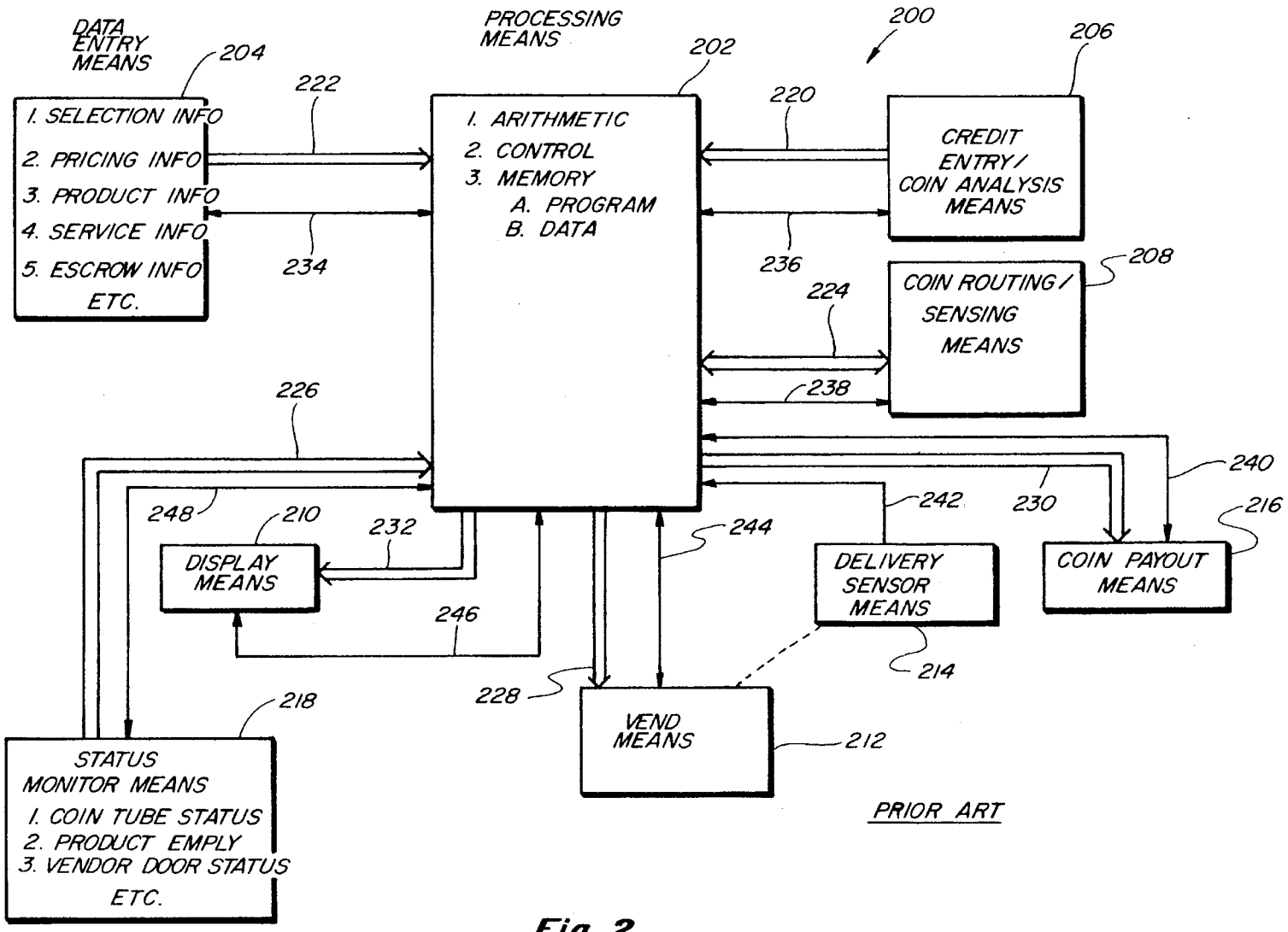
FIG. 2 is a block diagram of a vending system embodiment including a programmed microprocessor.

FIG. 2 illustrates, in block form, a microprocessor controlled vending system 200 that includes a processing means 202, data entry means 204, credit entry/coin analysis means 206, coin routing/sensing means 208, display means 210, vend means 212, delivery sensor means 214, coin payout means 216, and status monitor means 218. Processing means 202 includes memory means as well as arithmetic and control means typical of a microprocessor controlled vending system.

In system 200, coin analysis data may be supplied from the credit entry/coin analysis means 206 to the processing means 202 by means of a data path 220. Data information of various types, including selection information, pricing information, product information, and service information, may be provided from data entry means 204 to processing means 202 by means of a data path 222. Coin routing/sensing data may be provided from coin routing/sensing means 208 to processing means 202 by means of a data path 224. Status data, including coin tube status information, product empty information, and vendor status information, may be provided from status monitor means 218 to processing means 202 by means of a data path 226. Data for vend purposes may be provided from processing means 202 to vend means 212 by way of data path 228. Coin payout data may be provided from processing: means 202 to coin payout means 216 by way of data path 230, and information for display may be communicated from processing means 202 to display means 210 by means of data path 232. Various control and status signals may be intercommunicated among the components of the microprocessor controlled vending system means of signal paths 234, 236, 238,240, 242, 244, 246, and 248.

System 200 could be coupled to changer unit 100 (FIG. 1), with certain components in unit 100 forming part of the means illustrated in block form in FIG. 2. For example, credit entry/coin analysis means 206 could be formed, in part, by means 108. Coin routing/sensing means 208 could be formed, in part, by gates 110 and 112. The coin tube status monitor of monitor means 218 could be coupled to coin tubes 118, 120 and 122 and include counters and coin level detectors spaced along each coin tube.

With respect to coin counts, counters typically are associated with each coin tube 118, 120 and 122. Each time a coin is deposited into a tube, the associated counter is incremented by one. Each time a coin is removed from the tube, the counter decremented by one. A respective coin counter is reset (i.e., set to equal zero) if the associated tube is not full, and if coins are manually dispensed from the associated tube (e.g., by an operator performing coin collection or repairs), the tube is hand loaded to the full level (e.g., an operator manually fills the coin tube) as indicated by the uppermost level sensor, or the vending machine is reset, or upon power-up of the machine. If the tube is full and any of the above described events occur, the associated counter is not reset and retains its current value.

Coin changer unit 100 (FIG. 1) and microprocessor controlled vending system 200 (FIG. 2) illustrate only one of many changer units and vending systems. It will be readily apparent that many other changer units and vending systems might be equally well utilized in connection with the improved payout routine described below.

Figure 3:
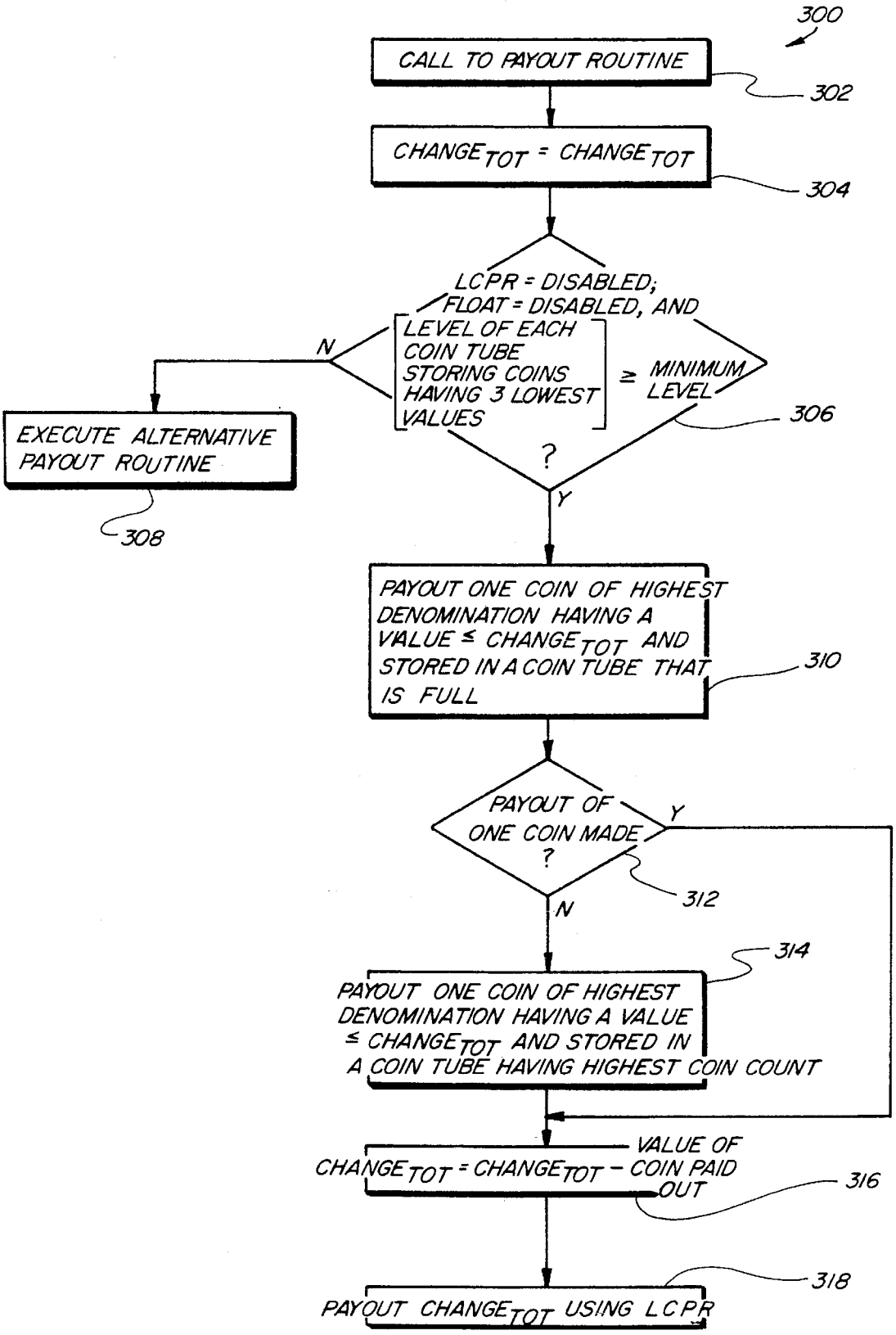
FIG. 3 is a flow chart illustrating one embodiment of a sequence of process steps for an improved payout routine that may be utilized with the vending machine system illustrated in FIG. 2.

FIG. 3 is a flow chart 300 illustrating a sequence of process steps for an improved coin payout routine. The process steps would, for example, be executed by processing means 202 controlled by a resident control program, often firmware. Many variations are possible, and many routines could be used in combination with such steps.

Referring now particularly to flow chart 300, once the payout routine is called as indicated at a step 302, processing means 202 determines the amount of change to be paid out at a step 304. Particularly, by subtracting the amount deposited by a customer from the vend price of the item selected by the customer, the total change ($CHANGE_{TOT}$) to be paid out is determined.

Once a value for $CHANGE_{TOT}$ is determined, three (3) conditions are checked to determine a payout routine to be used to make a payout as illustrated at a decision block 306. Specifically, the least coin payout routine ("LCPR") status flag and the "FLOAT" status flag are scanned to determine whether such functions/routines are DISABLED. The FLOAT function refers to the routing control of newly deposited coins and payback control as described in U.S. Pat. No. 4,587,984, which is assigned to the present assignee. Disabling the LCPR and FLOAT functions could be performed at the factory by setting a switch or setting a flag in the system memory. Alternatively, such functions could be disabled in the field using software tools or switches.

In addition to checking the status flags, the level of coins present in each of the three (3) coin tubes storing coins of the three (3) lowest denominations is checked to determine whether each such level is above a predetermined minimum level. More specifically, processing means 202 (FIG. 2) obtains data related to the level of coins stored in each such tube. Coin levels are determined, for example, from sensors placed along the length of each coin tube 118, 120 and 122 (FIG. 1). Depending on whether the coins in a particular tube are covering or not covering a portion of the tube adjacent a sensor, such sensor produces a "high" or a "low" signal. By reading the output signals from each sensor, the level of coins in each tube can be determined. Typically, a lowermost sensor provides an indication as to whether the quantity of coins in the associated tube has fallen to a level at which no further payout from such tube should be made until the tube is replenished (i.e., the minimum level). An uppermost sensor provides an indication as to whether the associated tube is full.

If any one of the above described three (3) conditions is not satisfied, then as illustrated at a step 308, an alternative payout routine (e.g., a "pure" least coin payout routine) is executed for making the payout. If all of such preconditions are satisfied, however, processing continues to a step 310.

At step 310, one coin having the highest value denomination but having a value less than or equal to $CHANGE_{TOT}$ and stored in a coin tube that is full is paid out. If no coin is paid out at step 310, then processing proceeds through decision block 312 to step 314 where one coin having a value less than or equal to $CHANGE_{TOT}$ is paid out from the coin tube having the highest coin count. The lowest denomination coin type preferably is not considered when executing step 314. Further, and with respect to step 314, if two or more coin denomination types have a value less than or equal to $CHANGE_{TOT}$ and their respective coin tubes have the same coin count, which also is the highest coin count, then as between such coin denomination types, one coin of the higher denomination coin type preferably is paid out.

Once a coin is paid out at steps 310 or 314, processing then proceeds to step 316. At step 316, $CHANGE_{TOT}$ is updated to equal the value of $CHANGE_{TOT}$ minus the value of the coin paid out. Once $CHANGE_{TOT}$ is so updated, processing proceeds to a step 318 where the updated value of $CHANGE_{TOT}$ is paid out using the least coin payout routine.

The improved payout routine, as is evident from the above description, facilitates enabling a vending machine to pay out change for long periods of time without requiring an operator to manually replenish the coin tubes. This result is provided by paying out at least one appropriate coin from a full coin tube or a coin tube having the highest coin count. Such payout control also facilitates maintaining a better mix of coins stored in the coin tubes which enables providing accurate payouts to customers for longer periods of time.

To provide further illustration of the improved payout routine, a table illustrating various payouts is set forth in FIG. 4. With respect to the vertical columns, the "Payout Amount" column refers to the amount to be paid out from the vending machine. The "Coin Types" (d-dollar, q-quarter, d-dimes, n-nickel) column refers to the types of coins contained in the vending machine. The "Coin Avail." column refers to the coin availability for each tube type. The "Least Coin Payout Routine" column identifies the quantity of coins for each coin type that would be paid out using a "pure" least coin payout. The "Improved Payout Routine" column identifies the quantity of coins for each coin type that would be paid out when executing the process steps illustrated in flow chart 300 of FIG. 3. The "Least Coin Payout Routine" column is illustrated for comparison purposes only. Further, for purposes of illustration, it is assumed that all the preconditions specified at step 306 of flow chart 300 are satisfied.

Referring to Payout No. 1 in FIG. 4, the amount to be paid out is seventy cents. The vending machine has quarter, dime and nickel coin tubes. All of the coin tubes are full (F). For such a payout, the least coin payout routine would payout two quarters and two dimes for payment.

With the Improved Payout Routine, since the quarter tube is full and could be used in making a payout, a quarter is initially paid out. $CHANGE_{TOT}$ is then set to equal 70¢–25¢, or 45¢. Using the Least Coin Payout Routine, or LCPR, to payout the updated $CHANGE_{TOT}$, one quarter and two dimes are paid out. The improved payout is identical, in this instance, to the LCPR ppayout.

With respect to Payout No. 2, one dollar and twenty cents is the Payout Amount. The vending machine contains dollar, quarter, dime and nickel coin tubes. Dollar coins are available, but the dollar coin tube is not full. The quarter, dime and nickel tubes are full. The Least Coin Payout Routine would payout one dollar coin and two dime coins.

With respect to the Improved Payout Routine, however, since the highest denomination coin in a full coin tube is a quarter, one quarter is paid out. $CHANGE_{TOT}$ is then updated to equal \$1.20–0.25¢, or 0.95¢.

Using the LCPR, the updated $CHANGE_{TOT}$ is quarters and two dimes. The Improved Payout Routine resulted in saving one dollar coin for possible future payout.

In Payout No. 3, the same Payout Amount and Coin Tubes are set as in Payout No. 2. However, in Payout No. 3, only the nickel tube is full. Therefore, one nickel initially is paid out using the Improved Payout Routine. $CHANGE_{TOT}$ is then sent to equal \$1.15. Using the LCPR, the updated value of $CHANGE_{TOT}$ is paid out with one dollar coin, one dime, and one nickel. As compared to Payout No. 2, and since only the nickel coin tube was full in Payout No. 3, more nickel coins were paid out in Payout No. 3.

In Payout No. 4, and as with Payout No. 3, the same Payout Amount and coin tubes are set as in Payout No. 2. However, in Payout No. 4, no coin tube is full. Therefore, no coin is paid out at step 310 and processing proceeds to step 314 (FIG. 3). At step 314, the tube coin counts are utilized to select one tube from which to pay one coin. As explained above, the coin count of the coin tube for the least value coin (in Payout No. 4, this would be the nickel coin tube) is not considered. Further, if two tubes considered have the highest but identical counter value, then as between such tubes, one coin is paid out from the tube storing the highest denomination coin type.

For example, in Payout No. 4, if the quarter coin tube has a coin count greater than the dime coin tube but equal to the count of the dollar coin tube, one dollar coin would be paid out. $CHANGE_{TOT}$ would be updated to equal 0.20¢. Then, using the LCPR, two dimes would be paid out.

The payouts set forth in the table of FIG. 4 illustrate various payouts and provide a comparison between the payouts made using the "pure" least coin payout routine and the improved payout routine.

Figure 5:
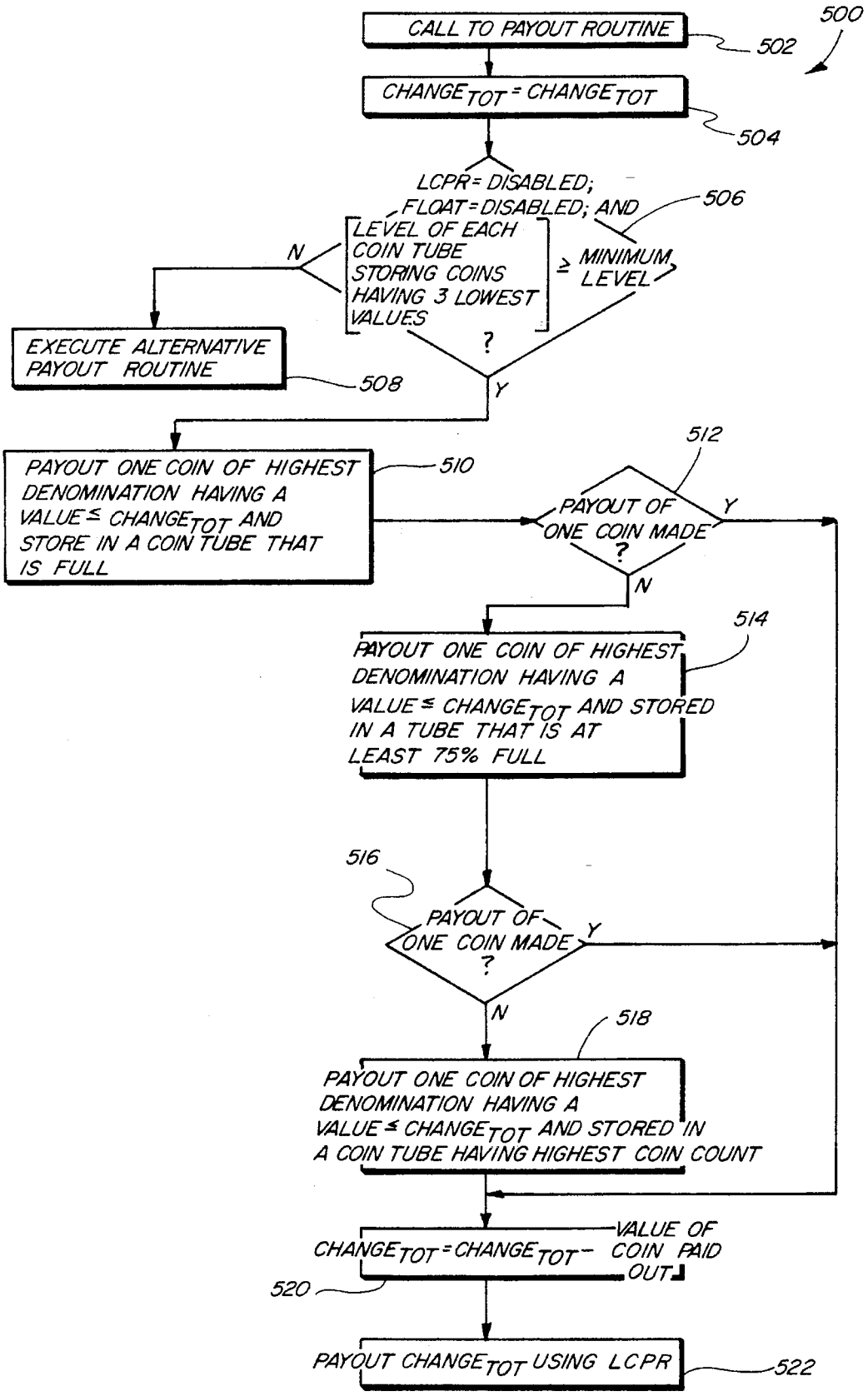
FIG. 5 is a flow chart illustrating another embodiment of a sequence of process steps for an improved payout routine that may be utilized with the vending machine system illustrated in FIG. 2.

FIG. 5 is a flow chart 500 illustrating a sequence of process steps in accordance with another embodiment of an improved payout routine. As with the steps illustrated in FIG. 3, the process steps illustrated in FIG. 5 would, for example, be executed by processing means 202 controlled by a resident control program, often firmware.

Referring now particularly to flow chart 500, once the payout routine is called as indicated at a step 502, processing means 202 determines the amount of change to be paid out at a step 504. Once a value for $CHANGE_{TOT}$ is determined, three (3) conditions are checked to determine a payout routine to be used to make a payout as illustrated at a decision block 506. Specifically, the least coin payout routine ("LCPR") status flag and the "FLOAT" status flag are scanned to determine whether such functions/routines are DISABLED. In addition to checking the status flags, the level of coins present in each of the three (3) coin tubes storing coins of the three (3) lowest denominations is checked to determine whether each such level is above a predetermined minimum level.

If any one of the above described three (3) conditions is not satisfied, then as illustrated at a step 508, an alternative payout routine (e.g., a "pure" least coin payout routine) is executed for making the payout. If all of such preconditions are satisfied, however, processing continues to a step 510.

At step 510, one coin having the highest value denomination but having a value less than or equal to $CHANGE_{TOT}$ and stored in a coin tube that is full is paid out. If no coin is paid out at step 510, then processing proceeds through decision block 512 to step 514. At step 514, an attempt is made to payout one coin of the highest denomination having a value less than or equal to $CHANGE_{TOT}$ and stored in a coin tube that is at least seventy-five percent full. The quantity of coins stored in each tube can be determined by utilizing the coin counts as hereinbefore described. Such coin counts can be verified against the signals generated by coin level sensors placed along the length of each tube. Of course, a percentage other than seventy-five percent, such as fifty percent, could be utilized. Also, the lowest denomination coin type preferably is not considered when executing step 514.

If no coin is paid out at step 514, then processing proceeds through decision block 516 to step 518 where one coin having a value less than or equal to $CHANGE_{TOT}$ is paid out from the coin tube having the highest coin count. The lowest denomination coin type preferably is not considered when executing step 518. Further, and with respect to step 518, if two or more coin denomination types have a value less than or equal to $CHANGE_{TOT}$ and their respective coin tubes have the same coin count, which also is the highest coin count, then as between such coin denomination types, one coin of the higher denomination coin type preferably is paid out.

Once a coin is paid out at steps 510, 514 or 518, processing then proceeds to step 520. At step 520, $CHANGE_{TOT}$ is updated to equal the value of $CHANGE_{TOT}$ minus the value of the coin paid out. Once $CHANGE_{TOT}$ is so updated, processing proceeds to a step 522 where the updated value of $CHANGE_{TOT}$ is paid out using the least coin payout routine.

Although the various embodiments of the improved payout routine have been described herein in specific forms thereof, many variations of such routine are contemplated and possible. For example, if a plurality of coin tubes are utilized for storing a same coin type, e.g., two nickel coin tubes, then the values of the counters associated with such coin tubes could be added together to provide a count for such coin type. If there are two nickel tubes with one nickel tube having a count of twenty and the other nickel tube having a count of negative five, the counts would be added together to provide a nickel coin count of fifteen.

Also, rather than using a coin count at steps 314 (FIG. 3) and 518 (FIG. 5), a coin ratio could be generated for each coin type. Particularly, if a coin ratio is to be determined, the coin tube status monitoring means would include two counters associated with each coin tube. With respect to each coin tube, a first counter is incremented each time a coin is deposited in the tube and a second counter is incremented each time a coin is paid out from the tube. The processing means determines a coin ratio by dividing the value of the first counter by the value of the second counter, i.e., coins in/coins out. As with the coin count, if a plurality of tubes are used to store a same coin type, the coin ratios could be combined to provide a total coin ratio.

Further, rather than using coin tube status data, coin type data could be utilized in executing steps 310 and 314 and steps 510, 514, and 518. For example, if a vending machine has three coin tubes for each coin denomination type, the quantity of each coin type rather than the status of each coin tube could be used to determine which coin to payout at step 310, e.g., rather than requiring that a coin tube be full, require that the quantity of coins in the machine exceed a predetermined level.

Moreover, the conditions set forth in decision blocks 306 and 506 for determining whether to proceed to steps 310 and 510, respectively, may vary from machine to machine, depending upon the specific machine configuration and operation. The conditions set forth at steps 306 and 506 are for illustration purposes only.

The improved payout routine as set forth above is easy to implement and is much less complex than routines which create a number of alternative payout combinations and then select the "best" combination for an actual payout. Further, by paying out at least one coin from a full coin tube, a partially full coin tube or the coin tube having the highest coin count, the improved payout routine facilitates saving coins which are more likely, as compared to other coin types, to be depleted. As a result, a better mix of coins is maintained in the coin tubes and the vending machine may payout change for long periods of time without requiring an operator to manually replenish the coin tubes.

The present routine, in one aspect, can be viewed as a value based payout system in that once certain predetermined conditions are satisfied, at least one coin is paidout based upon a predetermined set of rules. After payout of such coins, the amount of change due is updated and this amount of change is paid out using the LCPR or some other routine.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. The various described processing steps, for example, could be modified in many ways and still achieve the objectives of the present invention Accordingly, the spirit and scope of the invention are to be limited only by the terms of appended claims.

What is claimed is:

1. Apparatus for controlling change payout in a vending machine comprising a plurality of coin tubes, each coin tube having one coin denomination type stored therein, at least one counter associated with each coin tube for establishing and maintaining a count of coins stored in each coin tube, said apparatus further comprising a processor for processing data and controlling vend operations, said apparatus configured to:

(a) determine the mount of change ($CHANGE_{TOT}$) desired to be paid out during a vend operation; and (b) determine whether predetermined conditions are satisfied for a particular vend, and if said predetermined conditions are satisfied, and before paying out any other coins in the vend operation, (i) attempt to payout one coin having a value less than or equal to $CHANGE_{TOT}$ and from a coin tube that is full;

(ii) if one coin is not paid out at step (b) (i), attempt to payout one coin having a value less than or equal to $CHANGE_{TOT}$ and from a coin tube that is not full but has at least a predetermined quantity of coins stored therein;

(iii) if one coin is not paid out at step (b) (i) or step (b) (ii), payout one coin having a value less than or equal to $CHANGE_{TOT}$ from a coin tube having the highest coin count.

2. Apparatus in accordance with claim 1 wherein in performing step (b) (i), each coin tube of the vending machine is considered in identifying full coin tubes storing coin denomination types having a value less than or equal to $CHANGE_{TOT}$.

3. Apparatus in accordance with claim 2 wherein in performing step (b) (i), and if more than one coin tube is identified, then the one coin selected for payout is the highest coin denomination type stored in an identified coin tube.

4. Apparatus in accordance with claim 1 wherein in performing step (b) (ii), a coin tube storing a lowest value coin denomination type, as compared to the value of other coin denomination types stored in the other coin tubes, is not considered for payout.

5. Apparatus in accordance with claim 1 wherein in performing step (b) (ii), if more than one coin tube is identified as having at least the predetermined quantity of coins stored therein, and if the coin denomination type stored in more than one of the identified coin tubes has a value less than or equal to $CHANGE_{TOT}$ the one coin paid out is the highest denomination coin type stored in an identified coin tube.

6. Apparatus in accordance with claim 1 wherein in performing step (b) (ii), said predetermined coin quantity is a quantity at which the coin tube is no less than fifty percent full.

7. Apparatus in accordance with claim 1 wherein in performing step (b) (iii), a coin tube storing a lowest value coin denomination type, as compared to the value of other coin denomination types stored in the other coin tubes, is not considered for payout.

8. Apparatus in accordance with claim 1 wherein in performing step (b) (iii), if more than one coin tube is identified as having a coin count equal to a highest coin count and if the coin denomination type stored in more than one of the identified coin tubes has a value less than or equal to $CHANGE_{TOT}$, the one coin paid out is the highest denomination coin type stored in an identified coin tube.

9. Apparatus in accordance with claim 1 wherein said predetermined conditions at least include the condition that coin tubes storing the three lowest coin denomination types are full.

10. Apparatus in accordance with claim 1 wherein said apparatus is configured to payout change using an alternative payout routine if said predetermined conditions are not met.

11. Apparatus in accordance with claim 1 wherein the alternative payout routine is a least coin payout routine.

12. Apparatus in accordance with claim 1 wherein said apparatus, after paying out one coin from a full coin tube, from a coin tube that has at least a predetermined quantity of coins stored therein, or from a coin tube having the highest coin count, is configured to:

(iv) set $CHANGE_{TOT}$ equal to $CHANGE_{TOT}$ minus the value of the one coin paid out; and (v) payout $CHANGE_{TOT}$ using a preprogrammed payout routine.

13. Apparatus in accordance with claim 12 wherein the preprogrammed payout routine is a least coin payout routine.

14. A method of paying out change from a vending machine, the vending machine having a plurality of coin tubes, each coin tube having one coin denomination type stored therein, said method comprising the steps of:

(a) determining the total amount of change payout ($CHANGE_{TOT}$) required;

(b) before paying out any other coins, attempting to payout one coin of the highest value denomination type, as compared to the other coin denomination types stored in the machine coin tubes, having a value less than or equal to $CHANGE_{TOT}$ and stored in a coin tube that is full; and (c) if one coin is not paid out at step (b), attempting to payout one coin having a value less than or equal to $CHANGE_{TOT}$ and from a coin tube that is :not full but has at least a predetermined quantity of coins stored therein; and (d) if a coin is not paid out at steps (b) or (c), then paying out one coin having a value less than or equal to $CHANGE_{TOT}$ and from a coin tube having a highest coin count.

15. A method in accordance with claim 14 wherein in performing step (b), each coin tube of the vending machine is considered in identifying full coin tubes storing coin denomination types having a value less than or equal to $CHANGE_{TOT}$.

16. A method in accordance with claim 15 wherein in performing step (b), and if more than one coin tube is identified, then the one coin selected for payout is the highest coin denomination types stored in an identified coin tube.

17. A method in accordance with claim 14 wherein in performing step (c), a coin tube storing a lowest value coin denomination type, as compared to the value of other coin denomination types stored in the other coin tubes, is not considered for payout.

18. A method in accordance with claim 14 wherein in performing step (c), if more than one coin tube is identified as having at least a predetermined quantity of coins stored therein, and if the coin denomination type stored in more than one of the identified coin tubes has a value less than or equal to $CHANGE_{TOT}$, the one coin paid out is the highest denomination coin type stored in an identified coin tube.

19. A method in accordance with claim 14 wherein said predetermined coin quantity is a quantity at which the coin tube is no less than fifty percent full.

20. A method in accordance with claim 14 wherein in performing step (d), a coin tube storing a lowest value coin denomination type, as compared to the value of other coin denomination types stored in the other coin tubes, is not considered for payout.

21. A method in accordance with claim 14 wherein in performing step (d), if more than one coin tube is identified as having a coin count equal to a highest coin count and if the coin denomination type stored in more than one of the identified coin tubes has a value less than or equal to $CHANGE_{TOT}$, the one coin paid out is the highest denomination coin type stored in an identified coin tube.

22. A method in accordance with claim 14 wherein before executing steps (b), (c) and (d), the step of determining whether predetermined conditions are satisfied is executed, said predetermined conditions at least including the condition that coin tubes storing the three lowest coin denomination types are full.

23. A method in accordance with claim 22 wherein an alternative payout routine is executed if said predetermined conditions are not met.

24. A method in accordance with claim 23 wherein the alternative payout routine is a least coin payout routine.

25. A method in accordance with claim 14 wherein after paying out one coin in accordance with steps (b), (c) and (d), said method further comprises the steps of:

(e) setting $CHANGE_{TOT}$ equal to $CHANGE_{TOT}$ minus the value of the one coin paid out; and (f) paying out $CHANGE_{TOT}$ using a preprogrammed payout routine.

26. A method in accordance with claim 25 wherein the preprogrammed payout routine is a least coin payout routine.

* * * * *

UNITED STATES PATENT AND TRADEMARK OFFICE

CERTIFICATE OF CORRECTION

PATENT NO. : 5,577,957

DATED : November 26, 1996

INVENTOR(S) : Ronald A. Hoormann, et al

It is certified that error appears in the above-indentified patent and that said Letters Patent is hereby corrected as shown below:

Column 7, line 23, "ppayout" should be --payout--.

Column 11, line 34, ":not" should be --not--.

Signed and Sealed this

Twenty-fourth Day of June, 1997

Bruce Lehman

*Attest:*

BRUCE LEHMAN

*Attesting Officer*

*Commissioner of Patents and Trademarks*